US011127371B2

(12) United States Patent
Keith et al.

(10) Patent No.: US 11,127,371 B2
(45) Date of Patent: Sep. 21, 2021

(54) EXTENDING BRIGHTNESS DIMMING RANGE OF DISPLAYS VIA IMAGE FRAME MANIPULATION

(71) Applicant: Rockwell Collins, Inc., Cedar Rapids, IA (US)

(72) Inventors: Christopher A. Keith, Wilsonville, OR (US); Michael A. Ropers, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 16/553,487

(22) Filed: Aug. 28, 2019

(65) Prior Publication Data

US 2021/0065653 A1 Mar. 4, 2021

(51) Int. Cl.

| | |
|---|---|
| ***G09G 3/20*** | (2006.01) |
| ***G09G 5/10*** | (2006.01) |
| ***G09G 5/00*** | (2006.01) |

(52) U.S. Cl.

CPC ..... *G09G 5/10* (2013.01); *G09G 3/2088* (2013.01); *G09G 5/001* (2013.01)

(58) Field of Classification Search

CPC ..... G09G 5/10; G09G 5/001; G09G 3/2088
See application file for complete search history.

(56) References Cited

U.S. PATENT DOCUMENTS

| | | | | |
|---|---|---|---|---|
| 9,244,275 | B1 | 1/2016 | Li | |
| 2012/0224062 | A1* | 9/2012 | Lacoste | G02B 27/01 348/148 |
| 2016/0086574 | A1* | 3/2016 | Buckley | G09G 5/10 345/690 |
| 2017/0006257 | A1* | 1/2017 | Staudenmaier | H04N 7/0105 |
| 2018/0274974 | A1 | 9/2018 | Wang | |
| 2018/0330697 | A1* | 11/2018 | Lee | G09G 5/363 |
| 2019/0250461 | A1 | 8/2019 | Andreev et al. | |

OTHER PUBLICATIONS

Extended Search Report dated Apr. 29, 2020 for EP Application No. 19216030.
U.S. Appl. No. 16/387,921, filed Apr. 18, 2019, Raynal et al.

* cited by examiner

*Primary Examiner* — Lisa S Landis
(74) *Attorney, Agent, or Firm* — Suiter Swantz pc llo

(57) ABSTRACT

A display system for extending a brightness dimming range of a display substrate is disclosed. In embodiments, the display system includes a display device including a display substrate configured to display at least one image. In embodiments, the display system further includes a controller communicatively coupled to the display substrate, the controller including one or more processors configured to execute a set of program instructions stored in a memory. The one or more processors may be configured to acquire a video stream including a plurality of image frames; selectively modify one or more characteristics of one or more image frames of the plurality of image frames to generate a modified video stream; and generate one or more control signals configured to cause the display device to display the modified video stream via the display substrate.

14 Claims, 8 Drawing Sheets

EXTENDING BRIGHTNESS DIMMING RANGE OF DISPLAYS VIA IMAGE FRAME MANIPULATION

BACKGROUND

Display devices (e.g., pixelated displays) require varying levels of brightness in different ambient lighting conditions. For example, a display device may be required to produce higher brightness levels during daytime operations (e.g., high ambient light conditions) to maintain sufficient image quality for a user. Conversely, a display device may be required to produce lower brightness levels during night-time operations (e.g., low ambient light conditions) to both maintain a sufficient image quality for a user and so as not to adversely affect a viewer's night-adapted vision.

Currently, the lighting efficiency of display devices (e.g., pixelated displays) has been improving by increasing the brightness per unit power or current. However, display devices have a minimum current requirement to achieve a minimum brightness operational state. This minimum brightness operational state makes it difficult to achieve consistent and well-controlled low-end brightness levels (e.g., dim brightness levels) which are required for night-time operations (e.g., low ambient light conditions). Furthermore, the low-end brightness levels are no longer achievable because the brighter, more efficient displays are unstable at low currents, resulting in poor image qualities or the display not turning on at low currents.

The low performance levels and unstable nature of display devices at low current levels (e.g., low brightness/luminance levels) results in displays having to be operated at higher brightness/luminance levels. These higher luminance levels have been found to be incompatible with night-time operations, as the contrast between the high-luminance display and the low ambient light surroundings negatively affect a user's night vision and/or the user's ability to see the real-world. Moreover, displaying aircraft symbology video streams overlaid on top of night-vision video streams may obscure the night vision video stream and/or degrade a user's night-adapted vision. Furthermore, the feasible range for dimming the display device for night operations is limited, as the display devices exhibit low image quality and instability at low brightness levels. In the field of avionics, the highest quality video image is of utmost importance when conducting night-time operations (e.g., low ambient light conditions). Accordingly, the inability of display devices to finely control luminance at low levels for use in low-ambient light conditions render them ill-suited for use in many aircraft settings.

Therefore, there exists a need for a system and method which cure one or more of the shortcomings identified above.

SUMMARY

A display system for extending a brightness dimming range of a display substrate is disclosed. In embodiments, the display system includes a display device including a display substrate configured to display at least one image. In embodiments, the display system further includes a controller communicatively coupled to the display substrate, the controller including one or more processors configured to execute a set of program instructions stored in a memory. The one or more processors may be configured to acquire a video stream including a plurality of image frames; selectively modify one or more characteristics of one or more image frames of the plurality of image frames to generate a modified video stream; and generate one or more control signals configured to cause the display device to display the modified video stream via the display substrate.

In some embodiments of the display system, the controller is configured to selectively modify a luminance level of the one or more image frames of the plurality of image frames.

In some embodiments of the display system, the controller is configured to selectively drop the one or more image frames of the plurality of image frames to form one or more dropped image frames.

In some embodiments of the display system, the controller is configured to selectively modify one or more characteristics of one or more image frames of the plurality of image frames to selectively adjust a time-averaged luminance level of the display substrate.

In some embodiments of the display system, the display system further includes one or more light sensors configured to collect ambient light readings.

In some embodiments of the display system, the controller is configured to selectively modify a luminance level of the one or more image frames of the plurality of image frames in response to a collected ambient light reading.

In some embodiments of the display system, the controller is configured to selectively decrease a luminance level of the one or more image frames in response to a collected ambient light reading below an ambient light threshold, and selectively increase a luminance level of the one or more image frames in response to a collected ambient light reading above an ambient light threshold.

In some embodiments of the display system, the controller is configured to selectively drop the one or more image frames of the plurality of image frames to generate one or more dropped image frames in response to a collected ambient light reading below an ambient light threshold.

In some embodiments of the display system, the controller is configured to acquire an additional video stream including a plurality of image frames; selectively modify one or more characteristics of one or more image frames of the plurality of image frames of the additional video stream to generate an additional modified video stream; combine the modified video stream with the additional modified video stream to generate a composite video stream; and generate one or more control signals configured to cause the display device to display the composite video stream via the display substrate.

In some embodiments of the display system, the controller is configured to determine a desired time-averaged luminance level of the composite video stream; and selectively modify one or more characteristics of one or more image frames of the plurality of image frames of the additional video stream to generate an additional modified video stream which is combinable with the modified video stream to generate the composite video stream which exhibits the desired time-averaged luminance level.

In some embodiments of the display system, the controller is configured to determine a time-averaged luminance level of the modified video stream; and selectively modify one or more characteristics of one or more image frames of the plurality of image frames of the additional video stream to generate an additional modified video stream which exhibits a substantially equivalent time-averaged luminance level of the modified video stream.

In some embodiments of the display system, the first video stream includes a surrounding environment video stream, and the additional video stream includes a symbology video stream.

In some embodiments of the display system, the video stream is received from one or more aircraft video sources.

In some embodiments of the display system, the display device comprises at least one of a head-up display (HUD), a head-mounted display (HMD), a helmet-mounted display, a head-worn display (HWD), or an aircraft cockpit display.

A display system for extending a brightness dimming range of a display substrate is disclosed. In embodiments, the display system includes a controller communicatively coupled to a display device including a display substrate, the controller including one or more processors configured to execute a set of program instructions stored in a memory. The controller may be configured to receive a first video stream including a plurality of image frames; perform one or more image frame manipulation processes on the first video stream to generate a modified video stream; and generate one or more control signals configured to cause the display device to display the modified video stream via the display substrate.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are provided for example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION

Figure 1:
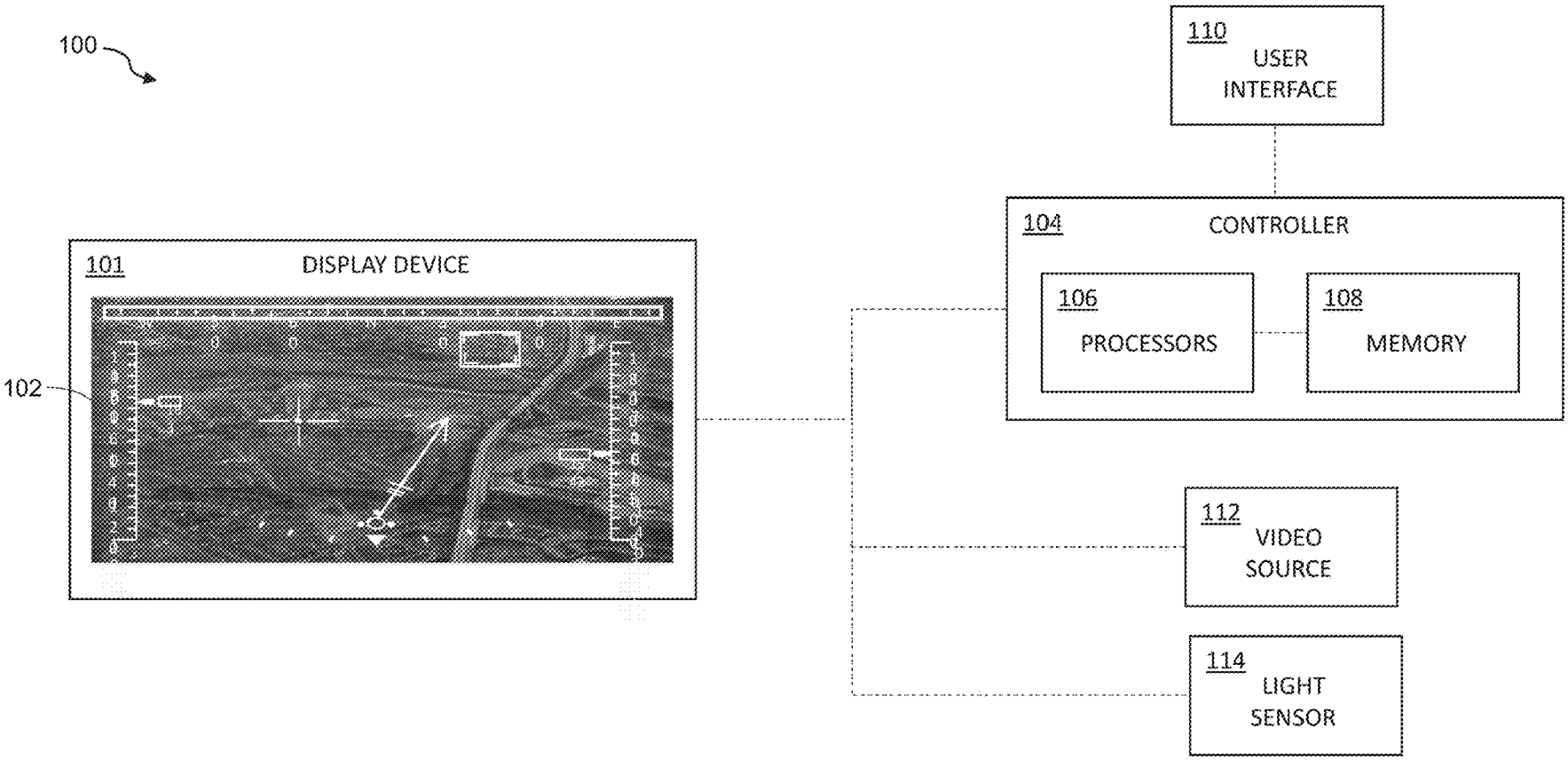
FIG. 1 illustrates a simplified block diagram of a display system for extending a brightness dimming range of a display substrate, in accordance with one or more embodiments of the present disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination of sub-combination of two or more such features, along with any other features which may not necessarily be expressly described or inherently present in the instant disclosure.

As noted previously herein, display devices are often required to produce varying levels of brightness/luminance in different ambient lighting conditions. By way of example, a display device may be required to produce higher brightness/luminance levels during daytime operations (e.g., high ambient light conditions) to maintain sufficient image quality for a user. In these high ambient light conditions, the pilot's helmet mounted display (HMD) as well as the aircraft's head-up displays (HUD) must maintain a brightness and contrast high enough to make the displays visible. Therefore, a high luminance level and efficiency is essential during day time operations.

Conversely, a display device may be required to produce lower brightness/luminance levels during night-time operations (e.g., low ambient light conditions) to both maintain a sufficient image quality for a user and so as not to adversely affect a viewer's night-adapted vision or view of the real-world. It has been found that the contrast between high luminance displays and the low ambient light surroundings during night time operations negatively affect a viewer's night vision or view of the real-world. Moreover, displaying aircraft symbology video streams overlaid on top of night-vision video streams may obscure the night vision video stream and/or degrade a user's night-adapted vision. Therefore, in order to allow pilots to maintain eyesight adapted for night vision and situational awareness of the real-world scene during night time operations, displays with low luminance levels are required.

Taken together, display devices which are capable of maintaining high luminance levels for high ambient light conditions and low luminance levels for low ambient light conditions are required. In particular, such display devices are required in aviation, where eyesight and visibility are of utmost importance.

Accordingly, embodiments of the present disclosure are directed to a display system and method for extending a brightness/luminance dimming range of a display device via image frame manipulation. More particularly, embodiments of the present disclosure are directed to extending a brightness/luminance dimming range of a display device by dropping image frames from a video stream and/or selectively modifying luminance levels of individual image frames. By selectively modifying luminance levels of individual image frames, the system and method of the present disclosure may be configured to extend a luminance dimming range of a display device on a time-based averaging basis. Further embodiments of the present disclosure are directed to generating a composite video stream by performing image frame manipulation on two or more video streams, and combining the two or more video streams.

It is contemplated herein that the image frame manipulation techniques of the present disclosure may enable display devices with improved luminance level dimming ranges. In particular, by adjusting a perceived luminance level (e.g., time-averaged luminance level) of a display substrate on a time-based averaging basis via image frame manipulation, the system and method of the present disclosure may enable display devices to effectively fine-tune luminance levels in both high and low luminance level environments. Moreover, by performing image frame manipulation, embodiments of the present disclosure may enable improved luminance dimming range of a display device while maintaining a minimum current requirement to the display device required for continuous and reliable operation.

FIG. 1 illustrates a simplified block diagram of a display system 100 for extending a brightness dimming range of a display substrate 102, in accordance with one or more embodiments of the present disclosure. The display system 100 may include, but is not limited to, a display device 101, a display substrate 102, a controller 104, one or more processors 106, and a memory 108. In embodiments, the system 100 may further include a user interface 110, one or more video sources 112, and one or more light sensors 114.

In embodiments, the display device 101 may include a display substrate 102. The display device 101 may include any display device known in the art including, but not limited to, a head-up display (HUD), a head-mounted display (HMD) a helmet-mounted display, a head-worn display (HWD), a vehicle-mounted display (e.g., aircraft cockpit display, automobile display), a mobile device display (e.g., smart phone display, handheld display, smart watch display, and the like). In this regard, while much of the present disclosure is directed to a system 100 in the context of an aircraft environment (e.g., aircraft cockpit display, HUD, HMD, HWD, and the like), it is contemplated herein that embodiments of the present disclosure may be applied to display devices 101 in contexts other than aircraft environments.

In embodiments, the display substrate 102 is configured to display at least one image. For example, the display substrate 102 may be configured to display one or more video streams including one or more image frames. For instance, as shown in FIG. 1, the display substrate 102 may be configured to display a composite video stream including a surrounding environment video stream overlaid with an aircraft symbology video stream.

The display substrate 102 may include a pixelated display substrate such that the display substrate includes a plurality of pixels. It is contemplated herein that the display substrate 102 may include any display substrate known in the art including, but not limited to, an emissive pixelated display substrate (e.g., OLED), a transmissive pixelated display substrate (e.g., LCD), a reflective pixelated display substrate (e.g., DLP), and the like.

It is noted herein that embodiments of the present disclosure are directed to performing image frame manipulation in order to modify a perceived luminance level of the display substrate 102 on a time-based averaging basis. In additional embodiments, the time-based averaging techniques of the present disclosure may be combined with techniques configured to modify the perceived luminance level of the display substrate 102 on a spatial-based averaging basis. For example, in embodiments where the display substrate 102 includes a pixelated display substrate including one or more pixels, the one or more pixels may be further divided up into sub-pixels. Each pixel and/or sub-pixel of the display substrate may be selectively modified via a sub-pixel drive. In this regard, the sub-pixel drive may be configured to selectively actuate sub-pixels in order to modify the perceived luminance level of the display substrate 102 on a spatial-based averaging basis. These spatial-based averaging techniques may be combined with the time-based averaging techniques of the present disclosure to further extend and/or modify a brightness/luminance dimming range of the display substrate 102. A sub-pixel drive configured to modify a perceived luminance level of the display substrate 102 on a spatial-based averaging basis is described in U.S. patent application Ser. No. 16/387,921, entitled DISPLAY WITH SUB-PIXEL DRIVE, filed on Apr. 18, 2019, naming Francois Raynal, Jeff R. Bader, and Christopher A. Keith as inventors, which is incorporated herein by reference in the entirety.

In embodiments, the display device 101 and/or the display substrate 102 may be communicatively coupled to a controller 104. The display device 101 and the display substrate 102 may be communicatively coupled to the controller 104 using any wireline or wireless communication technique known in the art. In embodiments, the controller 104 may include one or more processors 106 and a memory 108. Display system 100 may further include a user interface 110 communicatively coupled to the controller 104, wherein the user interface 110 is configured to display information of display system 100 to a user and/or receive one or more input commands from a user configured to adjust one or more characteristics of display system 100.

In some embodiments, the display system 100 may further include one or more video sources 112. The one or more video sources 112 may include any video sources known in the art configured to acquire images and generate a video stream including, but not limited to, a camera (e.g., video camera), a night vision camera (e.g., night vision video camera), an aircraft aerial reconnaissance camera, and the like. For example, the one or more aircraft video sources 112 may include a night vision camera configured to acquire and generate a video stream of the surrounding environment of an aircraft (e.g., surrounding environment video stream).

In additional embodiments, the display system 100 may include one or more light sensors 114. The one or more light sensors 114 may include any light sensors 114 known in the art including, but not limited to, ambient light sensors. For example, the one or more light sensors may include at least one of a photoresistor, a photodiode, a phototransistor, a photocell, a photovoltaic light sensor, a photo diode, a light-dependent sensor, and the like. The one or more light sensors 114 may be configured to collect ambient light readings associated with the environment of display system 100. For example, in the context of an aircraft, the one or more light sensors 114 may be configured to collect ambient light readings within the cockpit of the aircraft, wherein the ambient light readings are indicative of the amount of ambient light experienced by the pilot of the aircraft at a particular point in time. In this regard, continuing with the same example, the one or more light sensors 114 may collect high ambient light readings during the day, and low ambient light readings at night.

The one or more processors 106 may be configured to execute a set of program instructions stored in memory 108, the set of program instructions configured to cause the one or more processors 106 to carry out one or more steps of the present disclosure. For example, the one or more processors 106 of the controller 104 may be configured to: acquire a video stream including a plurality of image frames; selectively modify one or more characteristics of one or more image frames of the plurality of image frames to generate a modified video stream; and generate one or more control signals configured to cause the display device 201 to display the modified video stream via the display substrate 102. Each of the various steps/functions performed by the one or more processors 106 of the controller 104 will be discussed in further detail herein.

In embodiments, the controller 104 may be configured to acquire a video stream including a plurality of image frames. For example, as shown in FIG. 1, the controller 104 may be configured to receive a video stream from the one or more video sources 112. For instance, the one or more video sources 112 of an aircraft may be configured to acquire images/video to generate a video stream of the surrounding environment, and transmit the surrounding environment video stream to the controller 104. For the purposes of the present disclosure, "surrounding environment video stream," and like terms, may be used to refer to a video stream of the environment within which the display system 100 and/or display device 101 is operating. In the context of an aircraft, a surrounding environment stream may include a video stream of surrounding airspace when the aircraft is in flight, a video stream of the landscape below and/or surrounding the aircraft when the aircraft is in flight, a video stream of the ground/facility/runway when the aircraft is grounded, and the like. The controller 104 may be configured to store the received video stream in memory 108.

In additional and/or alternative embodiments, the controller 104 may be configured to "acquire" a video stream by generating a video stream. For example, the one or more processors 106 of the controller 104 may be configured to generate a symbology video stream indicative of one or more metrics or parameters associated with the display system 100, vehicle (e.g., aircraft), or the like. For example, it is noted herein that aircraft and other automobiles commonly use HUD or HMD displays which display data and information related to the aircraft or automobile including, but not limited to, speed, heading, altitude, engine revolutions per minute (RPM), engine temperature, and the like. In this example, a symbology video stream generated by the controller 104 may include a video stream which displays data associated with an aircraft in real-time and/or or near-real-time. It is further noted herein that symbology video streams may be overlaid on top of real-world sights to achieve augmented reality (e.g., projected onto a window or face mask), as well as combined and/or overlaid on top of other video streams to achieve virtual reality (e.g., overlaid on top of another video stream, such as a surrounding environment video stream).

The controller 104 may additionally and/or alternatively be configured to acquire a video stream from one or more external sources. For example, the controller 104 may be configured to receive a video stream transmitted from a terrestrial transmitting device (e.g., airport, base station, military base, terrestrial vehicle), an airborne transmitting device (e.g., satellite, aircraft, drone), and the like. In this regard, the video stream received/generated by the controller 104 may include any video stream which is to be displayed via the display device 101.

In embodiments, the controller 104 is configured to selectively modify one or more characteristics of one or more image frames of a video stream to generate a modified video stream. The modified video stream may then be stored in memory 108. The controller 104 may be configured to selectively modify one or more characteristics of one or more image frames of a video stream in order to selectively adjust a time-averaged luminance level of the display substrate 102/modified video stream. For example, the controller 104 may be configured to "drop," delete, remove, or replace one or more image frames within a video stream. By way of another example, the controller 104 may be configured to selectively modify a luminance level (e.g., brightness level) of more image frames from a video stream. Characteristics of image frames which may be selectively modified by the controller 104 may include, but are not limited to, the presence/absence of an image frame, a luminance level of an image frame, frequencies of light included within an image frame, and the like.

Selectively modifying characteristics of image frames within a video stream may be further shown and described with reference to FIGS. 2A-2B.

Figure 2A:
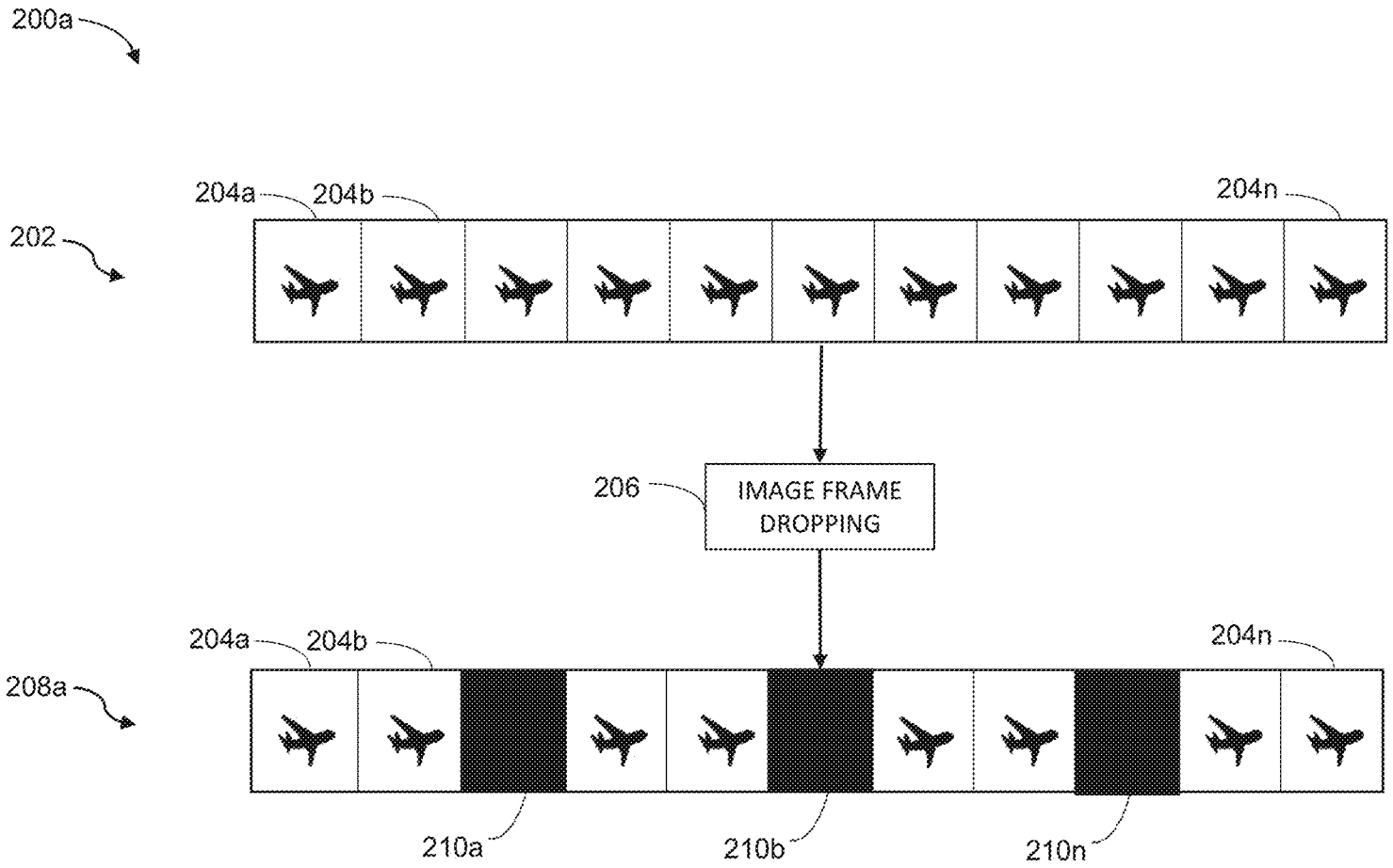
FIG. 2A illustrates a flowchart of a method for selectively modifying image frames of a video stream via image frame dropping, in accordance with one or more embodiments of the present disclosure.

FIG. 2A illustrates a flowchart of a method **200*a* for selectively modifying image frames 204*a*-204*n* of a video stream 202 via image frame dropping, in accordance with one or more embodiments of the present disclosure. It is noted herein that the steps of method 200*a* may be implemented all or in part by display system 100. It is further recognized, however, that the method 200*b* is not limited to the display system 100 in that additional or alternative system-level embodiments may carry out all or part of the steps of method 200***a*.

As noted previously, the controller 104 may receive and/or generate a video stream 202 including a plurality of image frames 204*a*, 204*b*, 204*n*. For example, as shown in FIG. 2A, the controller 104 may generate an aircraft symbology video stream 202 which is configured to display data associated with an aircraft (e.g., speed, altitude, heating, and the like) in real-time and/or near-real-time. For instance, as an aircraft is in flight, the aircraft symbology video stream 202 may be configured to continually update and display the current speed, altitude, and heading of the aircraft.

In embodiments, the controller 104 may be configured to perform image frame dropping processes 206 on the received/generated video stream 202 to generate a modified video stream 208*a*. In this regard, the modified video stream 208*a* may include one or more original image frames 204*a*-204*n* as well as one or more dropped image frames 210*a*-210*n*. The one or more dropped image frames 210*a*-210*n* may be formed using any technique known in the art. For example, the controller 104 may be configured to replace one or more image frames 204*a*-204*n* with black (e.g., dark) image frames to generate the one or more dropped image frames 210*a*-210*n*. By way of another example, the controller 104 may be configured to drop, delete, or otherwise remove one or more image frames 204*a*-204*n* on the video stream 202. For instance, as shown in FIG. 2A, the controller 104 may be configured to drop, delete, remove, or replace every third image frame 204*a*-204*n* of the video stream 202 such that the modified video stream 208*a* includes one dropped image frame 210*a*-210*n* for every two original image frames 204*a*-204*n*.

It is noted herein that the eyes of an ordinary user/viewer (e.g., aircraft pilot) typically are not able to perceive individual image frames of a video stream (e.g., video stream 202, modified video stream 210*a*). This is particularly true in the context of increasingly high frame rate video streams. Indeed, users are typically only capable of viewing a video stream in the aggregate as a sum total of the individual image frames. In this regard, the luminance level (e.g., brightness) of a display substrate 102, as it is perceived by a user, may be defined as a time-averaged luminance level of the individual image frames of the video stream. In other words, a perceived luminance level of a display substrate 102 may be defined as an average luminance level of the individual image frames of the video stream being displayed over a defined time period, where higher perceived luminance levels are indicative of higher brightness, and lower perceived luminance levels are indicative of lower brightness.

By including dropped image frames 210*a*-210*n* within the modified video stream 208*a*, which may appear dark/black, the modified video stream 208*a* may appear to exhibit a lower perceived luminance level (time-averaged luminance level) when displayed via the display substrate 102 as compared to the original video stream 202. In particular, as it is perceived by a user, time-averaging effects while viewing the modified video stream 208*a* result in a lower "perceived luminance level" (e.g., time-averaged luminance level) as compared to the original video stream 202.

The difference in time-averaged luminance levels (e.g., perceived luminance levels) between the video stream 202 and the modified video stream 208*a* may be a function of the ratio of dropped image frames 210*a*-210*n* to original (undropped) image frames 204*a*-204*n*. A higher ratio of dropped image frames 210*a*-210*n* to original image frames 204*a*-204*n* (e.g., more dropped image frames 210) may result in a modified video stream 208*a* with a lower time-averaged luminance level, whereas lower ratio of dropped image frames 210*a*-210*n* to original image frames 204*a*-204*n* (e.g., fewer dropped image frames 210) may result in a modified video stream 208*a* with a higher time-averaged luminance level as compared to the higher ratio of dropped image frames. It is further noted, however, that any number of dropped image frames 210 may result in a lower luminance level as compared to the original video stream. Accordingly, the controller 104 may be configured to selectively drop any number of image frames 204*a*-204*n* from the video stream 202 in order to achieve a modified video stream 208*a* with a desired/selected time-averaged luminance level.

The controller 104 may be further configured to selectively modify image frames 204 of a video stream 202 to adjust a time-averaged luminance level (e.g., perceived luminance level) of a display substrate 102 by selectively modifying luminance levels of individual image frames 204 of the video stream 202. This may be further understood with reference to FIG. 2B.

Figure 2B:
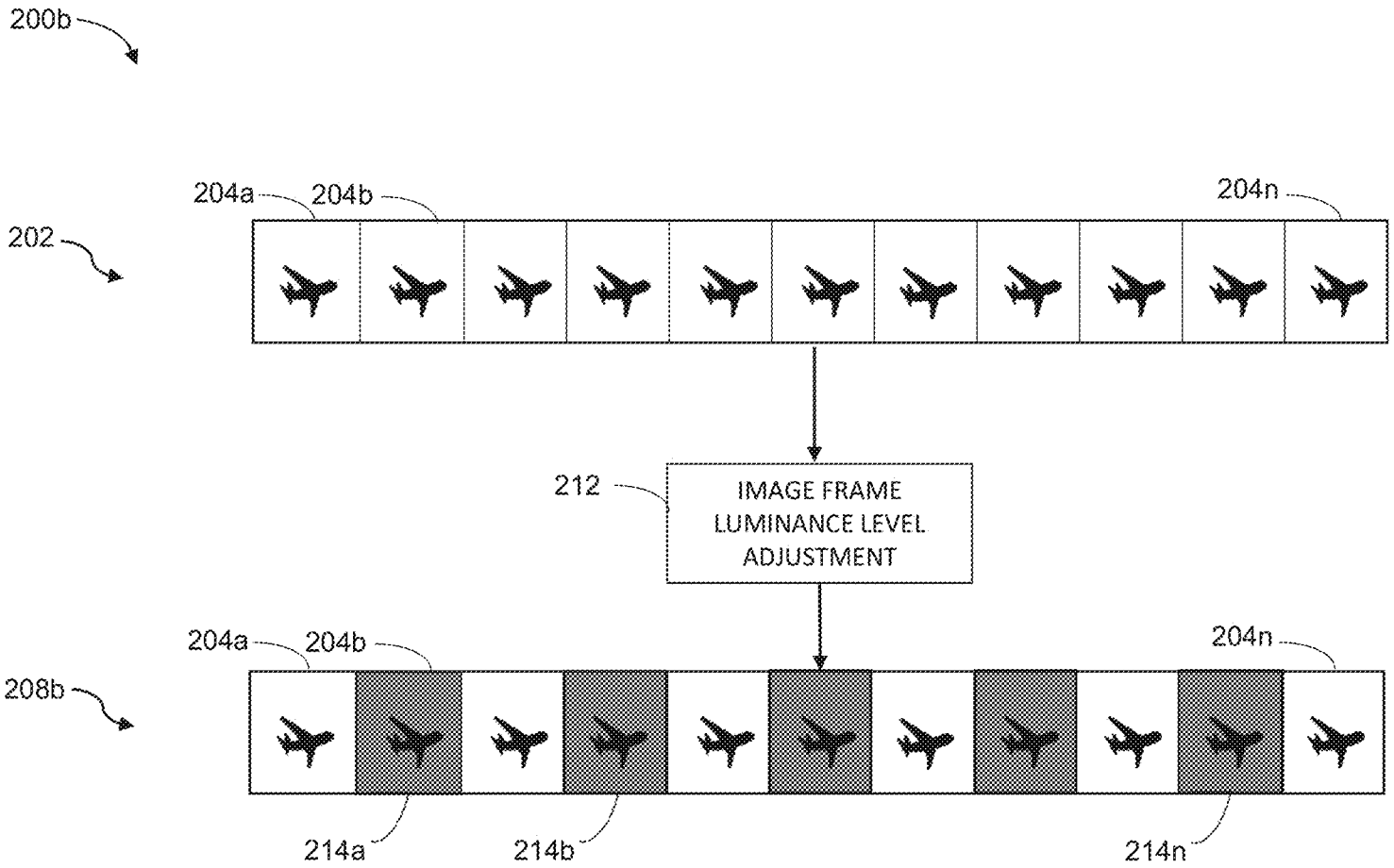
FIG. 2B illustrates a flowchart of a method for selectively modifying image frames of a video stream via image frame luminance level adjustment, in accordance with one or more embodiments of the present disclosure.

FIG. 2B illustrates a flowchart of a method 200*b* for selectively modifying image frames of a video stream 202 via image frame luminance level adjustment, in accordance with one or more embodiments of the present disclosure. It is noted herein that the steps of method 200*b* may be implemented all or in part by display system 100. It is further recognized, however, that the method 200*b* is not limited to the display system 100 in that additional or alternative system-level embodiments may carry out all or part of the steps of method 200*b*.

As noted previously, the controller 104 may receive and/or generate a video stream 202 including a plurality of image frames 204*a*, 204*b*, 204*n*. In embodiments, the controller 104 may be configured to perform image frame luminance level adjustment processes 212 on the received/generated video stream 202 to generate a modified video stream 208*b*. In this regard, the modified video stream 208*b* may include one or more original image frames 204*a*-204*n* as well as one or more luminance-altered image frames 214*a*-214*n*. For example, the controller 104 may be configured to adjust the luminance level of one or more image frames 204*a*-204*n* on the video stream 202. For instance, as shown in FIG. 2B, the controller 104 may be configured to adjust a luminance level of every other image frame 204*a*-204*n* of the video stream 202 such that the modified video stream 208*b* includes one luminance-altered image frame 214*a*-214*n* for every original image frame 204*a*-204*n*.

As noted previously herein with respect to image frame dropping in FIG. 2A, image frame luminance level adjustment in FIG. 2B may effectively adjust (e.g., decrease, increase) the time-averaged luminance level (e.g., perceived luminance level) of the modified video stream 208*b* displayed on the display substrate 102 due to time-averaging effects.

While FIGS. 2A and 2B illustrate the controller 104 selectively modifying image frames 204 by either image frame dropping or luminance level adjustment, this is not to be regarded as a limitation of the present disclosure, unless noted otherwise herein. In this regard, the controller 104 may be configured to a perform a combination of image frame dropping and luminance level adjustment on various image frames 204 of a video stream 202 in order to more precisely achieve a desired or selected time-averaged luminance level. For example, it is contemplated herein that dropping a large percentage of image frames 204 may cause a user to perceive a "flickering" effect on the display substrate 102. Thus, there may be a practical limit as to how many image frames 204 may be dropped completely. However, by performing a combination of image frame dropping and luminance level adjustment, the controller 104 may be able to achieve a sufficiently low time-averaged luminance level without introducing a "flickering" effect which is perceptible by a user.

In embodiments, the controller 104 may be further configured to generate one or more control signals configured to cause the display device 101 to display the modified video stream 208 via the display substrate 102. For example, the controller 104 may be configured to generate one or more control signals configured to cause the display substrate 102 of the display device 101 to display the modified video stream 208*a* illustrated in FIG. 2A. By way of another example, the controller 104 may be configured to generate one or more control signals configured to cause the display substrate 102 of the display device 101 to display the modified video stream 208*b* illustrated in FIG. 2B.

As noted previously herein the controller 104 may be configured to selectively modify characteristics of individual image frames 204 of a video stream 202 in order to selectively modify/adjust a time-averaged luminance level (e.g., perceived luminance level) of the display substrate 102 as it displays the modified video stream 208*a*, 208*b*. For example, by displaying a modified video stream 208*a*, 208*b*, the controller 104 may be configured to cause the display device 101 to exhibit a lower time-averaged luminance level (e.g., perceived luminance level) as would be the case if the original video stream 202 were to be displayed.

Adjusting a luminance level (e.g., brightness) of the display substrate 102 via image frame manipulation, as described herein, may enable many advantages over previous techniques. As noted previously herein, a display device 201 may be required to produce higher brightness/luminance levels during daytime operations (e.g., high ambient light conditions) to maintain sufficient image quality for a user, as well as lower brightness levels during night-time operations (e.g., low ambient light conditions) to both maintain a sufficient image quality for a user and so as not to adversely affect a viewer's night vision. By selectively modifying individual image frames 204 of a video stream 202, the display system 100 of the present disclosure may enable the display substrate 102 to exhibit high-brightness during high ambient light conditions, as well as low-brightness during low ambient light conditions. Improvements in the dynamic range of the display substrate 102 may be particularly important for some mission profiles, such as covert operations, and black hole approaches to airports, aircraft carriers, or other stealth-type landing zones.

Moreover, as noted previously herein, modern display devices 101 typically exhibit a minimum current requirement to achieve a minimum brightness operational state. This minimum brightness operational state makes it difficult to achieve the low-end brightness levels (e.g., low luminance levels) which are required for night-time operations. Accordingly, the display system 100 and method of the present disclosure may enable dynamic dimming range improvements of a display substrate 102 while simultaneously providing sufficient current to the display device 101 to ensure efficient and reliable operation. In particular, by modifying characteristics of individual image frames 204, the controller 104 of the display system 100 may effectively reduce the time-averaged luminance level of the display substrate 102 while not overly restricting the current provided to the display device 101. In this regard, the controller 104 may effectively improve the dimming range of the display substrate 102 to achieve time-averaged low luminance levels below the minimum brightness level of any single frame, while simultaneously meeting a minimum current requirement to achieve a minimum brightness operational state of the display device 101.

In some embodiments, the display system 100 may be configured to adaptively modify the time-averaged luminance level of the display substrate 102 in response to changing ambient light readings. As noted previously herein, for optimal performance, a display substrate 102 may be operated at high luminance levels during high ambient light conditions (e.g., daytime), and may further be operated at low luminance levels during low ambient light conditions (e.g., at night). In this regard, the controller 104 may be configured to adjust a time-averaged luminance level (e.g., perceived luminance level) of the display substrate 102 ("display substrate luminance level") in response to one or more collected ambient light readings by selectively modifying one or more characteristics of one or more image frames 204.

For example, at night, the one or more light sensors 114 may collect ambient light readings indicating low ambient light conditions (e.g., low ambient light readings). The controller 104 may then be configured to selectively modify one or more characteristics of one or more image frames 204 of a video stream 202 in order to lower the time-averaged luminance level of the display substrate 102 in response to the low ambient light reading. For instance, the controller 104 may be configured to drop one or more image frames 204 to generate one or more dropped image frames 210 and/or modify a luminance level of one or more image frames 204 to generate one or more luminance-altered image frames 214 with decreased luminance levels. By selectively modifying individual image frames 204, the controller 104 may be configured to lower the time-averaged luminance level of the display substrate 102 based on the low ambient light readings.

By way of another example, during the daytime, the one or more light sensors 114 may collect ambient light readings indicating high ambient light conditions (e.g., high ambient light readings). The controller 104 may then be configured to selectively modify one or more characteristics of one or more image frames 204 of a video stream 202 in order to increase the time-averaged luminance level of the display substrate 102 in response to the low ambient light reading. For instance, the controller 104 may be configure to cease dropping image frames from the video stream 202 in order to increase the time-averaged luminance level. Additionally and/or alternatively, the controller 104 may be configured to modify a luminance level of one or more image frames 204 to generate one or more luminance-altered image frames 214 with increased luminance levels.

In embodiments, the controller 104 may be configured to selectively alter/drop one or more image frames 204 depending on a comparison of collected ambient light readings to ambient light threshold values. For example, ambient light readings above an ambient light threshold value may be associated with a "day time mode" with a high display substrate luminance level, and ambient light readings below the ambient light threshold value may be associated with a "night time mode" with a low display substrate luminance level. For instance, the controller 104 may be configured to lower a time-averaged luminance level by dropping frames and/or decreasing a luminance level of one or more image frames 204 in response to collected ambient light readings below an ambient light threshold value. Conversely, the controller 104 may be further configured to increase a time-averaged luminance level by ceasing to drop frames and/or increasing a luminance level of one or more image frames 204 in response to collected ambient light readings above an ambient light threshold value.

While ambient light readings are described as being compared to a single ambient light threshold for a "day time mode" and a "night time mode," this is not to be regarded as a limitation of the present disclosure. In this regard, display system 100 may be configured to compare ambient light readings to any number of ambient light thresholds such that the display substrate 102 may be operated in a plurality of display "modes." For example, ambient light readings below a first ambient light threshold may be indicative of a "low brightness mode" or "night time mode," ambient light readings below the first ambient light threshold and below a second ambient light threshold may be indicative of an "intermediate brightness mode," and ambient light readings above the second ambient light threshold may be indicative of a "high brightness mode" or "day time mode."

Figure 3:
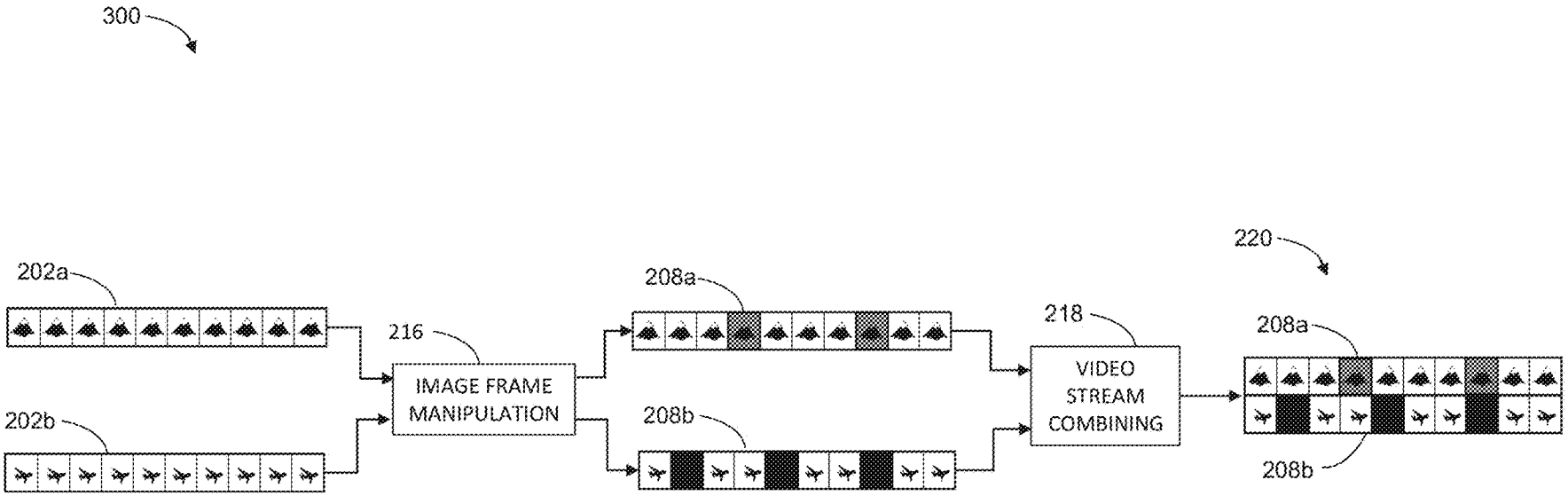
FIG. 3 illustrates a flowchart of a method for combining modified video streams generated via image frame manipulation processes, in accordance with one or more embodiments of the present disclosure.

FIG. 3 illustrates a flowchart of a method 300 for combining modified video streams 208 generated via image frame manipulation processes 216, in accordance with one or more embodiments of the present disclosure.

In addition to selectively modifying characteristics of image frames 204 within a single video stream 202, the display system 100 of the present disclosure may be further configured to generate one or more modified video streams 208, and combine the one or more modified video streams 208 with one or more additional video streams in order to generate a composite video stream 220.

It is noted herein that the composite video stream 220 may be generated by combining two or more video streams using any techniques known in the art including, but not limited to, overlaying multiple video streams, combining video streams in a "picture-in-picture" combined layout, abutting video streams next to one another, and the like.

For example, as shown in FIG. 3, the controller 104 may be configured to receive a first video stream 202*a*. For instance, the one or more video sources 112 of the display system 100 may be configured to acquire a video stream of the surrounding environment of an aircraft. In this regard, the first video stream 202*a* may include a surrounding environment video stream 202*a* which depicts landscapes and other views viewable by a pilot of an aircraft and/or the video sources 112.

Additionally, the controller 104 may be configured to receive a second video stream 202*b*. For instance, the controller 104 may be configured to generate/receive a video stream 202*b* which displays data and information related to the aircraft or automobile including, but not limited to, speed, heading, altitude, engine revolutions per minute (RPM), engine temperature, and the like. In this example, the second video stream 202*b* may include a symbology video stream 202*b* which displays data associated with an aircraft in real-time and/or or near-real-time.

Continuing with reference to FIG. 3, the controller 104 may be configured to carry out one or more image frame manipulation processes 216 on the first video stream 202*a* (e.g., surrounding environment video stream 202*a*) and the second video stream 202*b* (e.g., symbology video stream 202*b*). In this regard, the controller 104 may be configured to selectively modify one or more characteristics of one or more image frames 204 of the first video stream 202*a* and/or the second video stream 202*b*. The one or more image frame manipulation processes 216 may include, but are not limited to, image frame dropping processes 206 (FIG. 2A), and image frame luminance level adjustment processes 212 (FIG. 2B).

For example, as shown in FIG. 3, the controller 104 may be configured selectively adjust a luminance level of one or more image frames 204 of the first video stream 202*b* in order to generate a first modified video stream 208*a* including one or more luminance-altered image frames 214. Similarly, the controller 104 may be configured to selectively drop one or more image frames 204 of the second video stream 202*b* in order to generate a second modified video stream 208*b* including one or more dropped image frames 210.

In some embodiments, the controller 104 may be configured to selectively manipulate image frames of one video stream 202 in order to match, or approximately match, a luminance level of another video stream. For example, the controller 104 may be configured to drop one or more image frames 204 from the first video stream 202*a* (e.g., surrounding environment video stream 202*a*) to generate the first modified video stream 208*a*. The controller 104 may then be configured to determine a time-averaged luminance level (e.g., perceived luminance level) of the first video stream 202*a* (e.g., surrounding environment video stream 202*a*). Subsequently, the controller 104 may be configured to selectively modify one or more characteristics of the second video stream 202*b* (e.g., symbology video stream 202*b*) in order to generate the second modified video stream 208*b* which exhibits an equivalent, or substantially equivalent, time-averaged luminance level as the first modified video stream 208*b*.

It is contemplated herein that approximately matching luminance levels of video streams which are to be combined may prevent situations in which a heightened luminance level of a symbology video stream obscures a user's ability to view the surrounding environment and/or another video stream displayed on the display substrate 102.

In embodiments, the controller 104 may then be further configured to carry out video stream combining processes 218 in order to combine the first modified video stream 208*a* and the second modified video stream 208*b* to generate a composite video stream 220. The modified video streams 208*a*, 208*b* may be combined using any techniques known in the art. For instance, in the context of a surrounding environment video stream (e.g., first modified video stream 208*a*) and a symbology video stream (e.g., second modified video stream 208*b*), the two modified video streams 208*a*, 208*b* may be combined by overlaying the symbology video stream on top of the surrounding environment video stream. By way of another example, the first modified video stream 208*a* and the second modified video stream 208*b* may be combined in a "picture-in-picture" format where the second modified video stream 208*b* is inlaid within the first modified video stream 208*a*. By way of another example, the first modified video stream 208*a* and the second modified video stream 208*b* may be combined by abutting the modified video streams 208*a*, 208*b* adjacent to one another, where the second modified video stream 208*b* is disposed adjacent to the first modified video stream 208*a* (e.g., vertical "split screen," horizontal "split screen," and the like). It is futher noted herein that the composite video stream 220 generated by display system 100 may be generated by combining any number of video streams. In another embodiment, the controller 104 may be configured to generate one or more control signals configured to cause the display device 101 to display the composite video stream 220 via the display substrate 102.

It is noted herein that dropping one or more image frames from second video stream 202*b* (e.g., symbology video stream 202*b*), while simply lowering the luminance level of image frames within the first video stream 202*a* (e.g., surrounding environment video stream 202*a*), the controller 104 may lower the "effective frame rate" of the modified symbology video stream 208*b* with respect to the modified surrounding environment video stream 208*a*. It is contemplated that night vision video streams (e.g., surrounding environment video stream 202*a*, modified surrounding environment video stream 208*a*) may be required to be shown at a high effective frame rate in order to minimize effects of smearing, image ghosting, and motion blur. However, symbology video streams (e.g., symbology video stream 202*b*, modified symbology video stream 208*b*) may be shown at a lower effective frame rate, as shown in FIG. 3.

In some embodiments, the one or more image frame manipulation processes 216 performed on the first video stream 202*a* and/or the second video stream 202*b* may be performed in order to achieve a particular time-averaged luminance level of the composite video stream 220 displayed on the display substrate 102. For example, the controller 104 may receive one or more ambient light readings from the one or more light sensors 114. Based on the received ambient light readings, the controller 104 may be configured to determine a desired time-averaged luminance level of the display substrate 102 which will optimize a user's ability to view both the display substrate 102 and the surrounding real-world environment without adversely affecting a user's night-adapted vision in low ambient light conditions. Upon determining an optimal (e.g., desired) time-averaged luminance level, the controller 104 may perform the one or more image frame manipulation processes 216 on the first video stream 202*a* and/or the second video stream 202*b* in order to generate the composite video stream 220 which exhibits the desired time-averaged luminance level.

It is noted herein that the controller 104 may continually adjust and modify the one or more image frame manipulation processes 216 performed on the first video stream 202*a* and/or the second video stream 202*b* over time in response to changing ambient light conditions. In this regard, the one or more steps/functions carried out by the controller 104 on the video streams 202 may change and evolve over time.

Figure 4A:
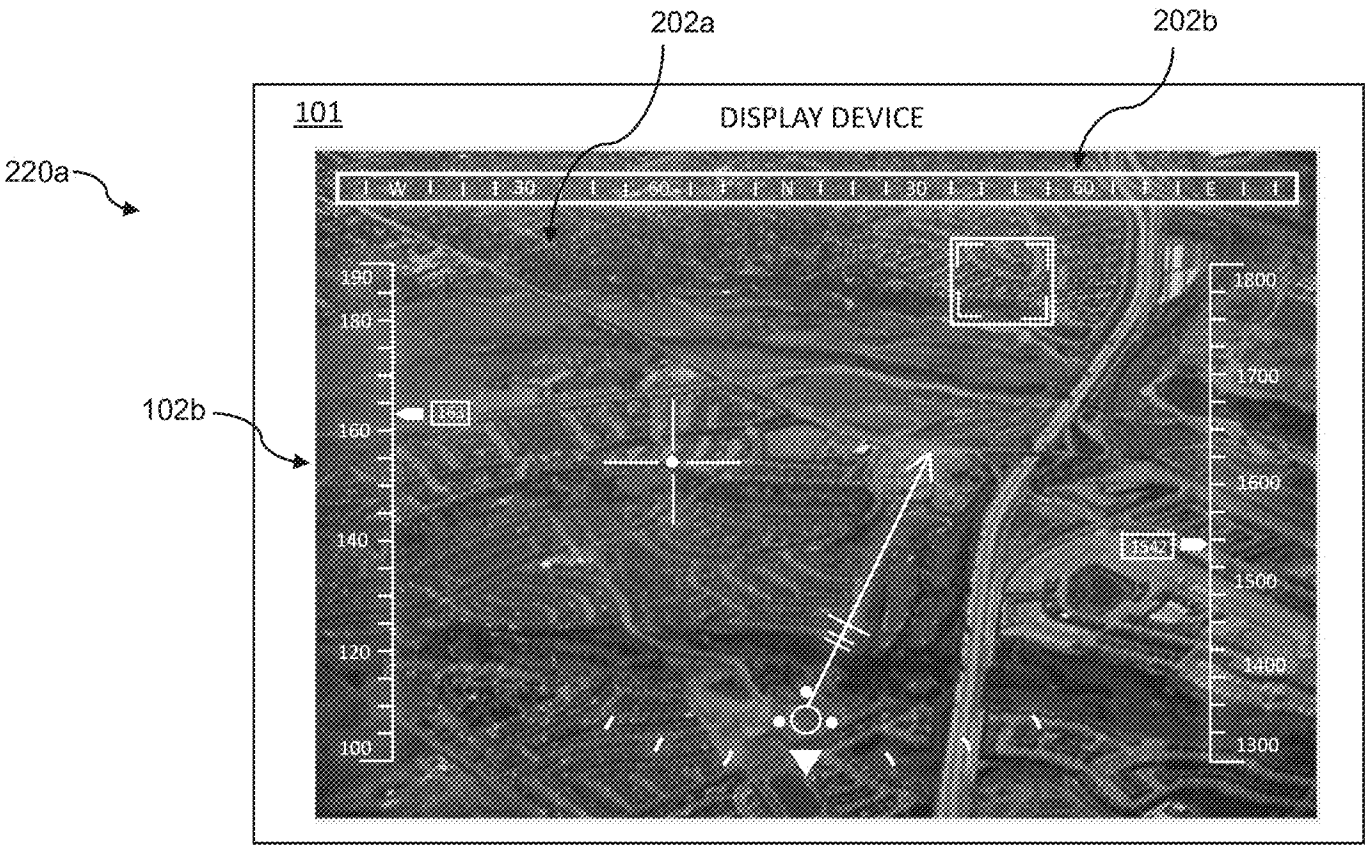
FIG. 4A illustrates a display substrate displaying a composite video stream, in accordance with one or more embodiments of the present disclosure.
Figure 4B:
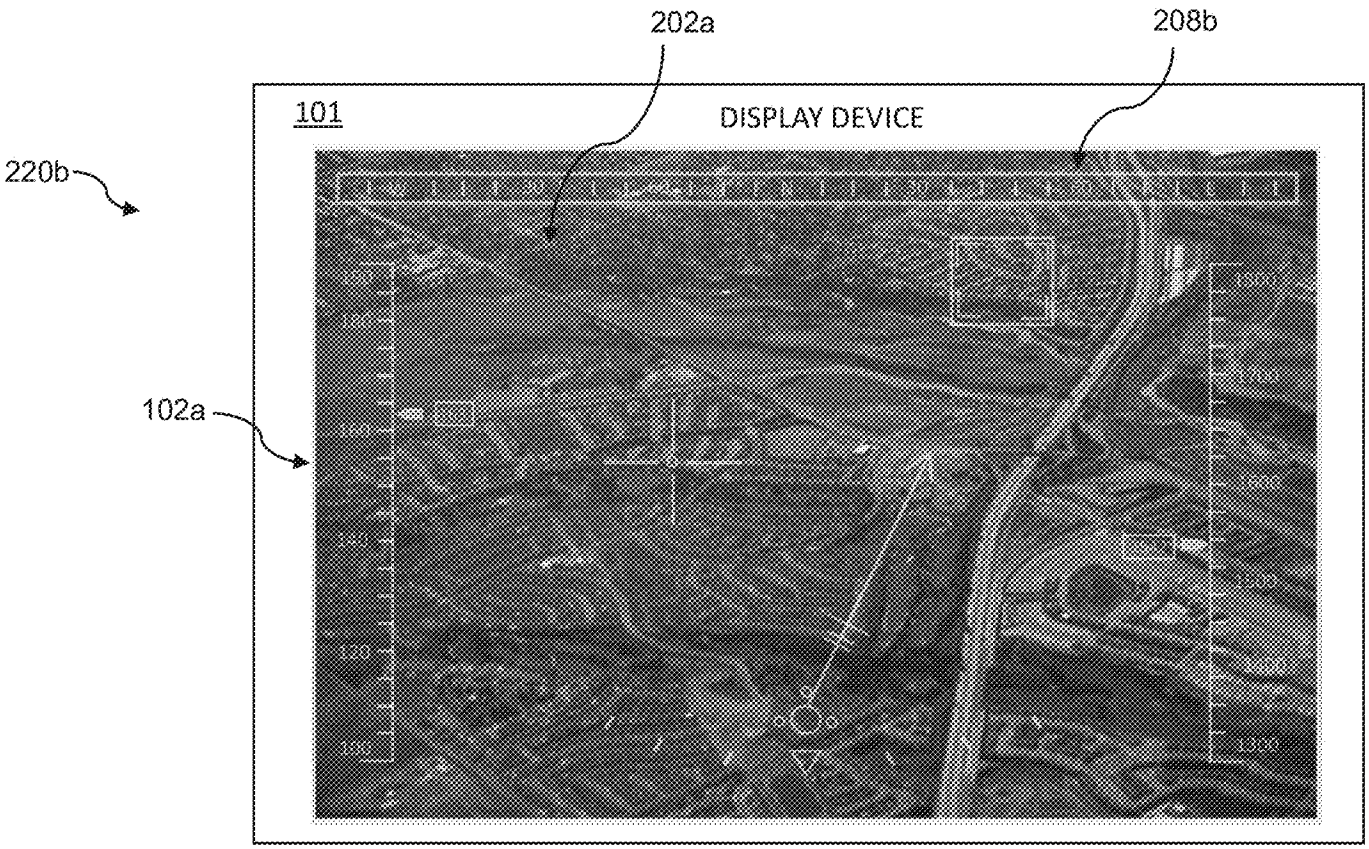
FIG. 4B illustrates a display substrate displaying a composite video stream generated by performing image frame manipulation processes on one or more video streams of the composite video stream, in accordance with one or more embodiments of the present disclosure.
Figure 4C:
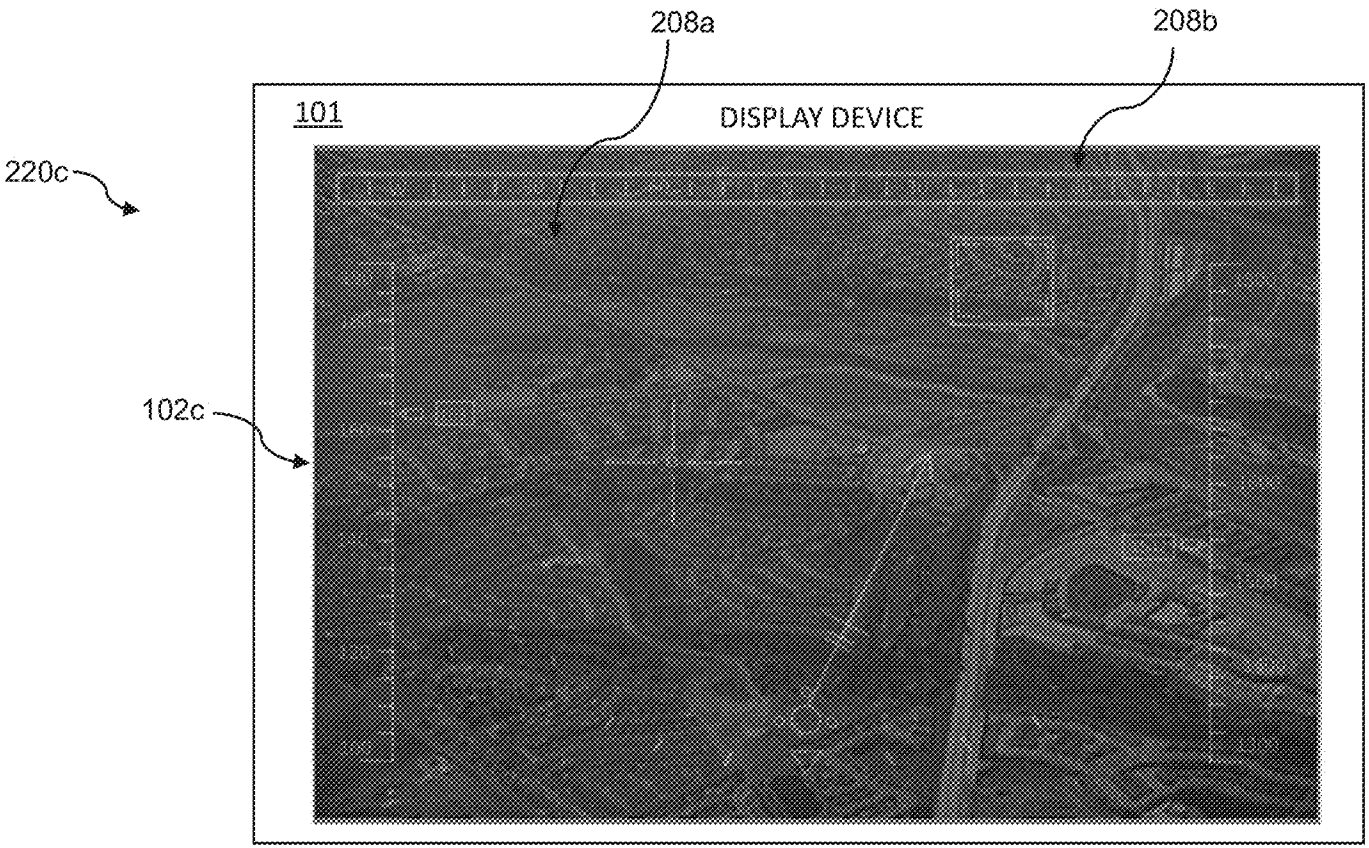
FIG. 4C illustrates a display substrate displaying a composite video stream generated by performing image frame manipulation processes on one or more video streams of the composite video stream, in accordance with one or more embodiments of the present disclosure.

Generally referring to FIGS. 4A-4C, a display substrate 102 displaying combined video streams 220*a*-220*c* are shown and described. In particular, FIGS. 4A-4C illustrate combined video streams 220*a*-220*c* generated by overlaying a second video stream 202*b* (e.g., symbology video stream 202*b*) on top of a first video stream 202*a* (e.g., surrounding environment video stream 202*a*). However, as noted previously herein, a combined video stream 220 may be generated by combining two or more video streams using any techniques known in the art including, but not limited to, overlaying multiple video streams, combining video streams in a "picture-in-picture" combined layout, abutting video streams next to one another, and the like. Accordingly, the overlay techniques shown in FIGS. 4A-4C are provided solely as examples, and are not to be regarded as limiting, unless noted otherwise herein.

FIG. 4A illustrates a display substrate 102 displaying a composite video stream 220*a*, in accordance with one or more embodiments of the present disclosure. In particular, the composite video stream 220*a* may include an un-modified first video stream 202*a* (e.g., surrounding environment video stream 202*a*) and an un-modified second video stream 202*b* (e.g., symbology video stream 202*b*). As shown in FIG. 4A, the symbology video stream 202*b* may be overlaid on top of the surrounding environment video stream.

The surrounding environment video stream 202*a* and the symbology video stream 202*b* illustrated in FIG. 4A may be un-modified in that the controller 104 has not dropped image frames and/or dimmed luminance level of image frames within the respective video streams 202*a*, 202*b* (e.g., no image frame manipulation processes 216). In this regard, each of the surrounding environment video stream 202*a* and the symbology video stream 202*b* may exhibit a "full" or high luminance level. Such high luminance levels may be used in the context of high ambient light conditions, and in conjunction with high ambient light readings collected by the one or more light sensors 114.

In low ambient light conditions, maintaining the surrounding environment video stream 202*a* and/or the symbology video stream 202*b* at a high time-averaged luminance level may obscure the other video stream and/or inhibit a user's (e.g., pilot's) ability to view the real-world surroundings. For example, maintaining the symbology video stream 202*b* at a high luminance level may obstruct the user's ability to see the surrounding environment video stream 202*a*, as well as adversely affect the user's night-adapted vision and which inhibits the user's ability to see the real-world surroundings. In this regard, the controller 104 may be configured to dim the symbology video stream 202*b*, as shown in FIG. 4B.

FIG. 4B illustrates a display substrate 102 displaying a composite video stream 220*b* generated by performing image frame manipulation processes 116 on one or more video streams 202 of the composite video stream 220*b*, in accordance with one or more embodiments of the present disclosure.

More particularly, the composite video stream 220*b* may include an un-modified surrounding environment video stream 202*a* and a modified symbology video stream 208*b*. The modified symbology video stream 208*b* may have been generated by performing one or more image frame manipulation processes 216 (e.g., image frame dropping, image frame luminance level dimming) on the un-modified symbology video stream 202*a* illustrated in FIG. 4A. In lowering the time-averaged luminance level of the modified symbology video stream 208*b*, the controller 104 may effectively lower the time-averaged luminance level of the composite video stream 220*b*, and thus improve a user's ability to view the display substrate 102 in low ambient light conditions.

Extremely low ambient light conditions may require even lower time-averaged luminance levels of the display substrate 102. For example, during covert operations and/or black hole approaches, the controller 104 may be configured to lower the time-averaged luminance level of the display substrate 102 by selectively modifying image frames of the surrounding environment video stream 202*a* and the symbology video stream 202*b*, as shown in FIG. 4C.

FIG. 4C illustrates a display substrate 102 displaying a composite video stream 220*c* generated by performing image frame manipulation processes 216 on one or more video streams 202 of the composite video stream 220*c*, in accordance with one or more embodiments of the present disclosure.

More particularly, the composite video stream 220*c* may include a modified surrounding environment video stream 208*a* and a modified symbology video stream 208*b*. The modified surrounding environment video stream 208*a* and the modified symbology video stream 208*b* may have been generated by performing one or more image frame manipulation processes 216 (e.g., image frame dropping, image frame luminance level dimming) in order to lower the time-averaged luminance level of the display substrate 102. In lowering the time-averaged luminance level of the modified surrounding environment video stream 208*a* and the modified symbology video stream 208*b*, the controller 104 may effectively lower the time-averaged luminance level of the composite video stream 220*c*, and thus improve a user's ability to view the display substrate 102 in extremely low ambient light conditions.

It is noted herein that the one or more components of display system 100 may be communicatively coupled to the various other components of display system 100 in any manner known in the art. For example, the display substrate 102, the controller 104, the one or more processors 106, the memory 108, the user interface 110, the one or more video sources 112, and/or the one or more light sensors 114 may be communicatively coupled to each other and other components via a wireline (e.g., copper wire, fiber optic cable, and the like) or wireless connection (e.g., RF coupling, IR coupling, WiFi, WiMax, Bluetooth, 3G, 4G, 4G LTE, 5G, and the like).

In one embodiment, the one or more processors 106 may include any one or more processing elements known in the art. In this sense, the one or more processors 106 may include any microprocessor-type device configured to execute software algorithms and/or instructions. In one embodiment, the one or more processors 106 may consist of a desktop computer, mainframe computer system, workstation, image computer, parallel processor, a field-programmable gate array (FPGA), multi-processor system-on-chip (MPSoC), or other computer system (e.g., networked computer) configured to execute a program configured to operate the display system 100, as described throughout the present disclosure. It should be recognized that the steps described throughout the present disclosure may be carried out by a single computer system or, alternatively, multiple computer systems. In general, the term "processor" may be broadly defined to encompass any device having one or more processing elements, which execute program instructions from memory 108. Moreover, different subsystems of the display system 100 (e.g., display device 101, user interface 110, video source 112, light sensors 114) may include one or more processor or logic elements suitable for carrying out at least a portion of the steps described throughout the present disclosure. Therefore, the above description should not be interpreted as a limitation on the present disclosure but merely an illustration.

The memory 108 may include any storage medium known in the art suitable for storing program instructions executable by the associated one or more processors 106. For example, the memory 108 may include a non-transitory memory medium. For instance, the memory 108 may include, but is not limited to, a read-only memory (ROM), a random-access memory (RAM), a magnetic or optical memory device (e.g., disk), a magnetic tape, a solid-state drive and the like. It is further noted that memory 108 may be housed in a common controller housing with the one or more processors 106. In an alternative embodiment, the memory 108 may be located remotely with respect to the physical location of the processors 106 and controller 104. In another embodiment, the memory 108 maintains program instructions for causing the one or more processors 106 to carry out the various steps described through the present disclosure.

In another embodiment, the controller 104 is coupled to a user interface 110. In another embodiment, the user interface includes a display and/or a user input device. For example, the display device may be coupled to the user input device by a transmission medium that may include wireline and/or wireless portions. The display device of the user interface 110 may include any display device known in the art. The display device of the user interface 110 may include the display device 101 or additional and/or alternative display devices. For example, the display device may include, but is not limited to, a liquid crystal display (LCD), an organic light-emitting diode (OLED) based display, a CRT display, and the like. Those skilled in the art should recognize that a variety of display devices may be suitable for implementation in the present invention and the particular choice of display device may depend on a variety of factors, including, but not limited to, form factor, cost, and the like. In a general sense, any display device capable of integration with a user input device (e.g., touchscreen, bezel mounted interface, keyboard, mouse, trackpad, and the like) is suitable for implementation in the present invention.

The user input device of the user interface 110 may include any user input device known in the art. For example, the user input device may include, but is not limited to, a keyboard, a keypad, a touchscreen, a lever, a knob, a scroll wheel, a track ball, a switch, a dial, a sliding bar, a scroll bar, a slide, a handle, a touch pad, a paddle, a steering wheel, a joystick, a bezel input device, or the like. In the case of a touchscreen interface, those skilled in the art should recognize that a large number of touchscreen interfaces may be suitable for implementation in the present invention. For instance, the display device may be integrated with a touchscreen interface, such as, but not limited to, a capacitive touchscreen, a resistive touchscreen, a surface acoustic based touchscreen, an infrared based touchscreen, or the like. In a general sense, any touchscreen interface capable of integration with the display portion of a display device is suitable for implementation in the present invention. In another embodiment, the user input device may include, but is not limited to, a bezel mounted interface.

Figure 5:
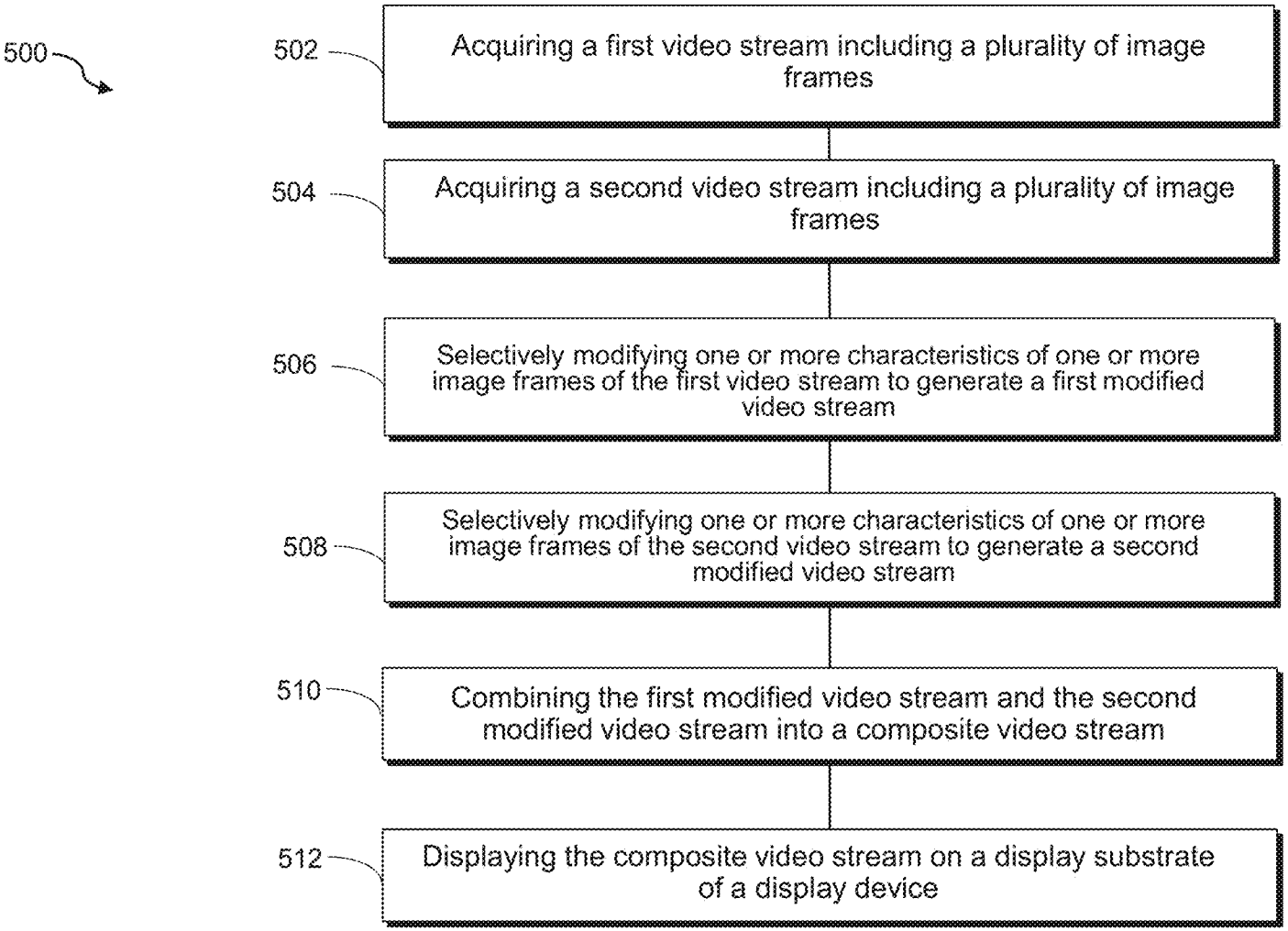
FIG. 5 illustrates a flowchart of a method for extending a brightness dimming range of a display substrate, in accordance with one or more embodiments of the present disclosure.

FIG. 5 illustrates a flowchart of a method 500 for extending a brightness dimming range of a display substrate 102, in accordance with one or more embodiments of the present disclosure. It is noted herein that the steps of method 500 may be implemented all or in part by system 100. It is further recognized, however, that the method 500 is not limited to the system 100 in that additional or alternative system-level embodiments may carry out all or part of the steps of method 500.

In a step 502, a first video stream including a plurality of image frames is acquired. For example, as shown in FIG. 3, the controller 104 may receive a surrounding environment video stream 202*a* including a plurality of image frames 204. The surrounding environment video stream 202*a* may be acquired by one or more video sources 112 communicatively coupled to the controller 104.

In a step 504, a second video stream including a plurality of image frames is acquired. For example, as shown in FIG. 3, the controller 104 may be configured to generate a symbology video stream 202*b* including a plurality of image frames 204. The symbology video stream 202*a* may depict data and information related to the aircraft or automobile including, but not limited to, speed, heading, altitude, engine revolutions per minute (RPM), engine temperature, and the like. In this regard, the symbology video stream 202*b* may display data associated with an aircraft in real-time and/or or near-real-time.

In a step 506, one or more characteristics of one or more image frames of the first video stream are selectively modified to generate a first modified video stream. For example, the controller 104 may be configured to perform one or more image frame manipulation processes 216 on the surrounding environment video stream 202*a* to generate a modified surrounding environment video stream 208*a*. For instance, the controller 104 may be configured to drop one or more image frames 204 from the surrounding environment video stream 202*a* and/or adjust a luminance level of one or more image frames 204 of the surrounding environment video stream 202*a*. It is noted herein that performing one or more image frame manipulation processes 216 may effectively adjust a time-averaged luminance level (e.g., perceived luminance level) of the modified surrounding environment video stream 202*a*.

In a step 508, one or more characteristics of one or more image frames of the second video stream are selectively modified to generate a second modified video stream. For example, the controller 104 may be configured to perform one or more image frame manipulation processes 216 on the symbology video stream 202*b* to generate a modified symbology video stream 208*b*. For instance, the controller 104 may be configured to drop one or more image frames 204 from the symbology video stream 202*b* and/or adjust a luminance level of one or more image frames 204 of the symbology video stream 202*b*.

While method 500 is shown and described as selectively modifying image frames 204 of both the surrounding environment video stream 202*a* and the symbology video stream 202*b*, this is not to be regarded as limiting, unless noted otherwise herein. In this regard, it is contemplated that the controller 104 may be configured to modify any number of video streams. For example, in some instances, the controller 104 may perform image frame manipulation processes 216 only on the symbology video stream 202*b*. By way of another example, in other instances, in some instances, the controller 104 may perform image frame manipulation processes 216 only on the surrounding environment video stream 202*a*.

In a step 510, the first modified video stream and the second modified video stream are combined. As noted previously herein, the composite video stream 220 may be generated by combining two or more video streams using any techniques known in the art including, but not limited to, overlaying multiple video streams, combining video streams in a "picture-in-picture" combined layout, abutting video streams next to one another, and the like. For example, the controller 104 may be further configured to carry out video stream combining processes 218 in order to combine the modified surrounding environment video stream 208*a* and the modified symbology video stream 208*b* to generate a composite video stream 220. For instance, the modified symbology video stream 208*b* may be overlaid on top of the modified surrounding environment video stream 208*a*.

In a step 512, the composite video stream is displayed on a display substrate of a display device. For example, as shown in FIG. 1, the controller 104 may be configured to generate one or more control signals configured to cause the display device 101 to display the composite video stream 220 via the display substrate 102.

It is to be understood that embodiments of the methods disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

What is claimed:

1. A display system for extending a brightness dimming range of a display substrate, comprising:

a display device usable within a vehicle, the display device including a display substrate configured to display at least one image; and a controller communicatively coupled to the display substrate, the controller including one or more processors configured to execute a set of program instructions stored in a memory, the set of program instructions configured to cause the one or more processors to:

acquire a video stream including a plurality of image frames from one or more video sources coupled to the vehicle and configured to acquire images and generate the video stream, the video stream having a select frame rate, the plurality of image frames being displayed by the display substrate of the display device in a sequential order at the select frame rate of the video stream;

selectively modify one or more characteristics of one or more image frames of the plurality of image frames to generate a modified video stream and to selectively adjust a time-averaged luminance level of the display substrate, wherein the time-average luminance level of the display substrate is determined by a ratio of a number of dropped image frames to a number of original or un-dropped image frames; and generate one or more control signals configured to cause the display device to display the modified video stream via the display substrate.

2. The display system of claim 1, wherein selectively modifying one or more characteristics of one or more image frames of the plurality of image frames to generate a modified video stream comprises:

selectively modifying a luminance level of the one or more image frames of the plurality of image frames.

3. The display system of claim 1, wherein selectively modifying one or more characteristics of one or more image frames of the plurality of image frames to generate a modified video stream comprises:

selectively dropping the one or more image frames of the plurality of image frames to form one or more dropped image frames.

4. The display system of claim 1, further comprising one or more light sensors configured to collect ambient light readings.

5. The system of claim 4, wherein selectively modifying one or more characteristics of one or more image frames of the plurality of image frames to generate a modified video stream comprises:

selectively modifying a luminance level of the one or more image frames of the plurality of image frames in response to a collected ambient light reading.

6. The system of claim 5, wherein selectively modifying a luminance level of the one or more image frames of the plurality of image frames in response to a collected ambient light reading comprises:

selectively decreasing a luminance level of the one or more image frames in response to a collected ambient light reading below an ambient light threshold; and selectively increasing a luminance level of the one or more image frames in response to a collected ambient light reading above the ambient light threshold.

7. The system of claim 5, wherein selectively modifying a luminance level of the one or more image frames of the plurality of image frames in response to a collected ambient light reading comprises:

selectively dropping the one or more image frames of the plurality of image frames to generate one or more dropped image frames in response to a collected ambient light reading below an ambient light threshold.

8. The display system of claim 1, wherein the one or more processors are further configured to:

acquire an additional video stream including a plurality of image frames;

selectively modify one or more characteristics of one or more image frames of the plurality of image frames of the additional video stream to generate an additional modified video stream;

combine the modified video stream with the additional modified video stream to generate a composite video stream; and generate one or more control signals configured to cause the display device to display the composite video stream via the display substrate.

9. The display system of claim 8, wherein selectively modifying one or more characteristics of one or more image frames of the plurality of image frames of the additional video stream to generate an additional modified video stream comprises:

determining the time-averaged luminance level of the composite video stream; and selectively modifying one or more characteristics of one or more image frames of the plurality of image frames of the additional video stream to generate an additional modified video stream which is combinable with the modified video stream to generate the composite video stream which exhibits the time-averaged luminance level.

10. The display system of claim 8, wherein selectively modifying one or more characteristics of one or more image frames of the plurality of image frames of the additional video stream to generate an additional modified video stream comprises:

determining the time-averaged luminance level of the modified video stream; and selectively modifying one or more characteristics of one or more image frames of the plurality of image frames of the additional video stream to generate an additional modified video stream which exhibits a substantially equivalent time-averaged luminance level of the modified video stream.

11. The display system of claim 8, wherein the video stream comprises a surrounding vehicle environment video stream including the environment in which the vehicle is operating, and the additional video stream comprises a vehicle symbology video stream including data or information related to the operation of the vehicle.

12. The display system of claim 11, wherein the video stream is received from one or more aircraft video sources.

13. The display system of claim 11, wherein the display device comprises at least one of a head-up display (HUD), a head-mounted display (HMD), a helmet-mounted display, a head-worn display (HWD), or an aircraft cockpit display.

14. A display system for extending a brightness dimming range of a display substrate, comprising:

a controller communicatively coupled to a display device including a display substrate, the display device usable within a vehicle, the controller including one or more processors configured to execute a set of program instructions stored in a memory, the set of program instructions configured to cause the one or more processors to:

receive a first video stream including a plurality of image frames from one or more video sources coupled to the vehicle and configured to acquire images and generate the first video stream, the first video stream having a select frame rate, the plurality of image frames being displayed by the display substrate of the display device in a sequential order at the select frame rate of the first video stream;

perform one or more image frame manipulation processes on the first video stream to generate a modified video stream and to selectively adjust a time-averaged luminance level of the display substrate, wherein the time-average luminance level of the display substrate is determined by a ratio of a number of dropped image frames to a number of original or un-dropped image frames; and generate one or more control signals configured to cause the display device to display the modified video stream via the display substrate.

* * * * *